US005078436A

United States Patent [19]

Kleefeldt et al.

[11] Patent Number: 5,078,436

[45] Date of Patent: * Jan. 7, 1992

[54] MOTOR-VEHICLE DOOR WITH ANTITHEFT OVERRIDE

[75] Inventors: Frank Kleefeldt, Heiligenhaus; Johannes T. Menke, Velbert, both of Fed. Rep. of Germany

[73] Assignee: Kiekert GmbH & Co. Kommanditgesellschaft, Heiligenhaus, Fed. Rep. of Germany

[ * ] Notice: The portion of the term of this patent subsequent to Dec. 4, 2007 has been disclaimed.

[21] Appl. No.: 596,926

[22] Filed: Oct. 12, 1990

Related U.S. Application Data

[63] Continuation-in-part of Ser. No. 389,652, Aug. 4, 1989, Pat. No. 4,974,886.

[30] Foreign Application Priority Data

Aug. 13, 1988 [DE] Fed. Rep. of Germany ..... 3827611
Jan. 31, 1989 [DE] Fed. Rep. of Germany ..... 3902776

[51] Int. Cl.[5] ..... E05C 3/06

[52] U.S. Cl. ..... 292/201; 292/216; 70/264

[58] Field of Search ..... 70/264, 262, 263, 265; 292/216, 201

[56] References Cited

U.S. PATENT DOCUMENTS 4,304,249 12/1982 Kleefeldt ..... 70/264
4,342,209 8/1982 Kleefeldt ..... 70/264
4,440,000 4/1984 Kleefeldt ..... 70/264

FOREIGN PATENT DOCUMENTS 3443287 6/1986 Fed. Rep. of Germany .

*Primary Examiner*—Richard E. Moore
*Attorney, Agent, or Firm*—Herbert Dubno; Andrew M. Wilford

[57] ABSTRACT

A motor-vehicle door latch for use on a vehicle door having a handle and a locking element has a housing, a latch fork pivotal on the housing and engageable in a locking position with a door bolt to retain same and lock the door, an operating lever pivoted on the housing and connected to the handle, a locking lever pivoted on the housing and connected to the respective locking element, and an actuating lever operatively engageable with the fork to release same from the locking position. A link coupled to the locking lever is displaceable thereby between a position coupling the operating lever to the actuating lever for displacement of the fork out of the locking position by actuation of the operating lever and a position decoupling the operating lever from the actuating lever. Thus in the decoupling position actuation of the operating lever will not unlock the door. A central actuator in the latch can displace an antitheft lever into an antitheft position thereof and mechanism between the antitheft lever and the link decouples the locking lever from the actuating lever in the antitheft position of the antitheft lever so that the antitheft position actuation of the inside lever will not be able to release the fork.

7 Claims, 4 Drawing Sheets

MOTOR-VEHICLE DOOR WITH ANTITHEFT OVERRIDE

CROSS REFERENCE TO RELATED APPLICATION

This is a continuation-in-part of copending application Ser. No. 07/389,652 filed Aug. 4, 1990, now U.S. Pat. No. 4,974,886, issued Dec. 4, 1990.

FIELD OF THE INVENTION

The present invention relates to a motor-vehicle door latch. More particularly this invention concerns such a latch provided with an antitheft feature.

BACKGROUND OF THE INVENTION

A standard door latch for a motor vehicle includes a housing mounted on the door edge and formed with a recess into which is engageable a bolt projecting from the respective door post. A fork is pivotal in the housing between a latching position engaging around the bolt and holding it solidly in the recess and a freeing position permitting the bolt to enter and leave the recess. A latch pawl engageable with the fork can hold it in the latched position. The latch pawl in turn is typically spring loaded and can be controlled via appropriate levers both from an inside door handle and an outside door handle, either of which can therefore operate the latch to allow the door to be opened.

In addition the door can be locked by means of a button or lever inside the door and a key cylinder outside the door, and also frequently by an actuator operated by a central lock system. When locked the outside door handle is either impeded from moving so it cannot move the latch pawl, or it is decoupled from the latch pawl so its actuation is ineffective.

In a standard lock system the inner door handle and inner lock button or lever remain effective even when the door is locked so that the outside handle does not work. In an antitheft system, however, there is, in addition to the locked and unlocked conditions of the latch, an antitheft mode or position in which the latch cannot be opened by either of the door handles and in which the inside lock element is also ineffective to unlock the door. Thus when in the antitheft position a would-be thief cannot even open the door by forcing the window and operating the door from inside.

As described in U.S. Pat. Nos. 4,342,209 of F. Kleefeldt and 4,669,283 of J. Ingehoven the antitheft position is set by an electric-motor actuator having a motor whose output shaft is a spindle on which is threaded a nut that acts as a detent that physically impedes and latches the inside lock element in the locked position. Thus the structure must be strong enough to withstand whatever force the would-be thief is willing to apply. Hence the elements must be made fairly robust and, therefore, are of expensive manufacture.

Another substantial disadvantage of the known antitheft systems is that the antitheft position is set by an actuator, typically an electric motor, and the latch can only be reset out of this antitheft position by means of this motor. Thus if the vehicle's electric power fails it becomes fairly impossible to enter the vehicle, even for someone with the right key that typically can operate the main central-lock switch. Similarly if the connection to a one of the latch actuators fails or one of the electric motors burns out, the respective latch can be left stuck in the antitheft position and painstaking disassembly of the door is required to effect the necessary repair.

OBJECTS OF THE INVENTION

It is therefore an object of the present invention to provide a improved antitheft-type motor-vehicle door latch.

Another object is the provision of such an improved antitheft-type motor-vehicle door latch which overcomes the above-given disadvantages, that is which is of simple and inexpensive construction and that can readily be reset from the antitheft position even when the electric power fails or the respective actuator no longer operates.

SUMMARY OF THE INVENTION

A motor-vehicle door latch for use on a vehicle door having a handle and a locking element according to the invention has a housing, a latch fork pivotal on the housing and engageable in a locking position with a door bolt to retain same and lock the door, an operating lever pivoted on the housing and connected to the handle, a locking lever pivoted on the housing and connected to the respective locking element, and an actuating lever operatively engageable with the fork to release same from the locking position. A link coupled to the locking lever is displaceable thereby between a position coupling the operating lever to the actuating lever for displacement of the fork out of the locking position by actuation of the operating lever and a position decoupling the operating lever from the actuating lever. Thus in the decoupling position actuation of the operating lever will not unlock the door. A central actuator in the latch can displace an antitheft lever into an antitheft position thereof and mechanism between the antitheft lever and the link decouples the locking lever from the actuating lever in the antitheft position of the antitheft lever so that in the antitheft position actuation of the inside lever will not be able to release the fork.

With the system of this invention, therefore, in the antitheft position the inside levers are not blocked from operating to prevent the door from being opened, for instance by someone who has broken the window, but instead they are merely decoupled from the latch mechanism. Thus the inside operating and locking elements can be actuated but they will not do anything. As a result it is not necessary to make the actuator very robust to resist such forced entry, making the latch simpler and cheaper to build.

According to the invention the antitheft lever is provided with a formation engageable with the link to retain same in the decoupling position in the antitheft position of the antitheft lever. In addition the link includes a pin and the actuating lever is formed with an elongated slot through which the pin projects. The antitheft-lever formation is an abutment engageable with the pin.

Furthermore in accordance with this invention the antitheft lever and locking lever are provided with interengageable override formations and the locking lever is displaceable into an override position engaging the override formations together and pulling the abutment of the antitheft lever out of engagement with the pin. Thus even if the power fails with the door in the antitheft position, a holder of the door key can override the antitheft position and open the door.

The actuator according to the present invention is a motor provided with a spindle in turn provided with a nut engaging the antitheft lever. In addition a latch pawl is connected between the actuating lever and the fork and the mechanism includes a second antitheft lever pivotal independently of the first-mentioned antitheft lever and a lost-motion coupling interconnecting the two antitheft levers.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
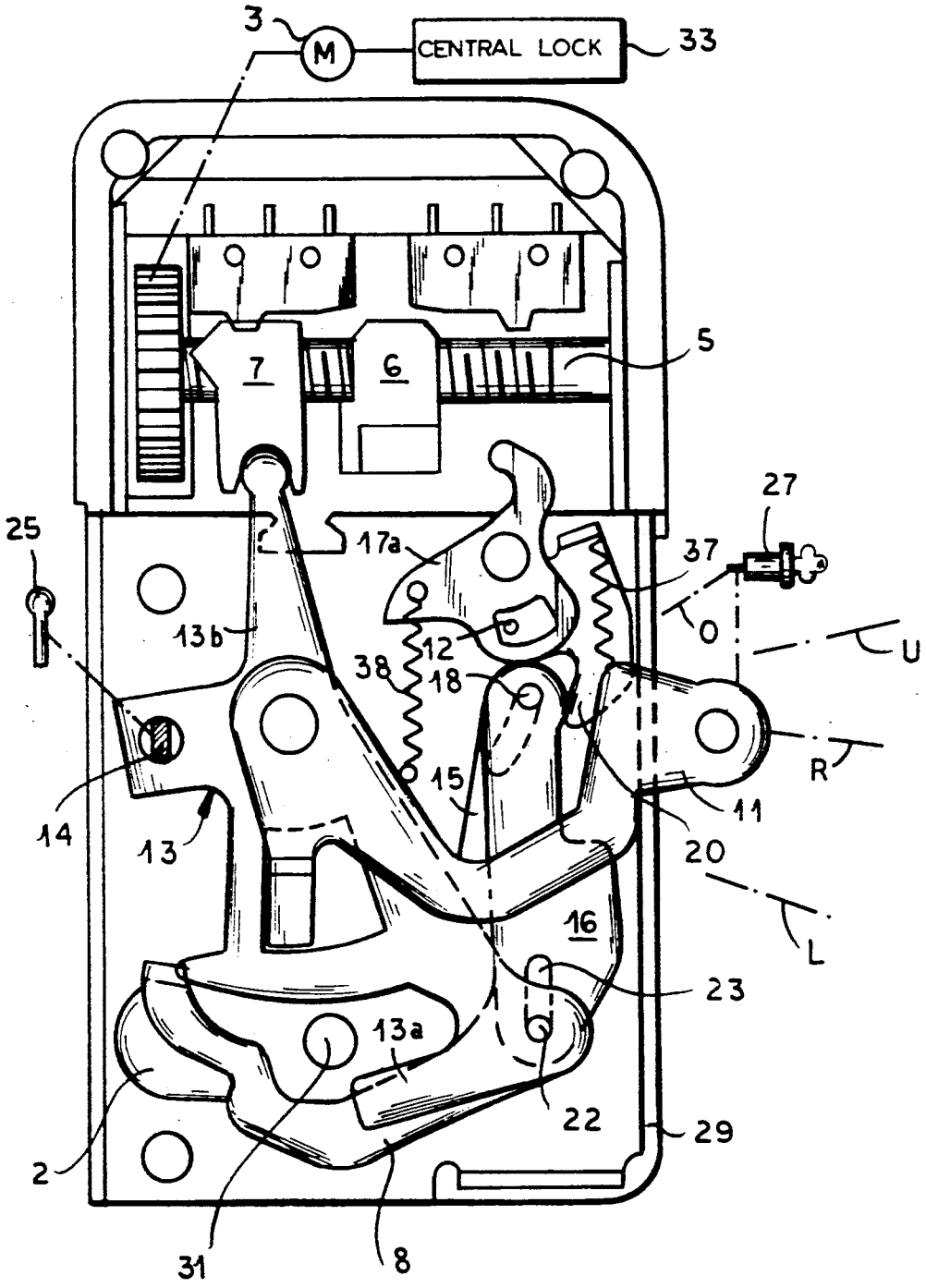
FIG. 1 is a vertical section through the latch according to this invention in the unlocked position.

As seen in FIGS. 1 through 4 a motor-vehicle door latch has a housing 29 normally mounted on a door edge and formed with a cutout into which a bolt 30 (FIG. 2) projecting from the respective door post can engage. A pivotal fork 1 (FIG. 2) can engage over this bolt 30 to lock it in place and a latch pawl 2 is pressed by an unillustrated spring to normally engage this fork 1 and hold it in the locking position.

The latch has a servoactuator, here an electric motor shown schematically at 3, that can be operated by a central lock system shown schematically at 33. This motor 3 rotates a threaded spindle 5 on which is threaded a nut 6 engageable with a latch-operating slider 7.

An operating lever 8 (FIG. 2) is pivoted on the housing 29 and connected to a door handle 26. An outer locking lever 11 movable between a lock position L, a rest position R, an unlock position U, and an override position O is connected to a key-operated cylinder 27. An actuating lever 15 has one arm engageable with a pin 31 on the pawl 2 to release the fork 1 and another arm formed with a slot 19 in which is engaged a pin 18 fixed on a link 16 mounted via another slot 23 on a pivot pin 22 on an inner locking lever 13 coupled to the outer locking lever 11 and also via a lever 14 to an inside door-locking button 25. The pin 18 engages through the slot 19 and can either be aligned with the lever 8 so that pivoting of this lever 8 operates the lever 15 and opens the latch, or can be out of alignment with the other arm of the lever 8.

Figure 2:
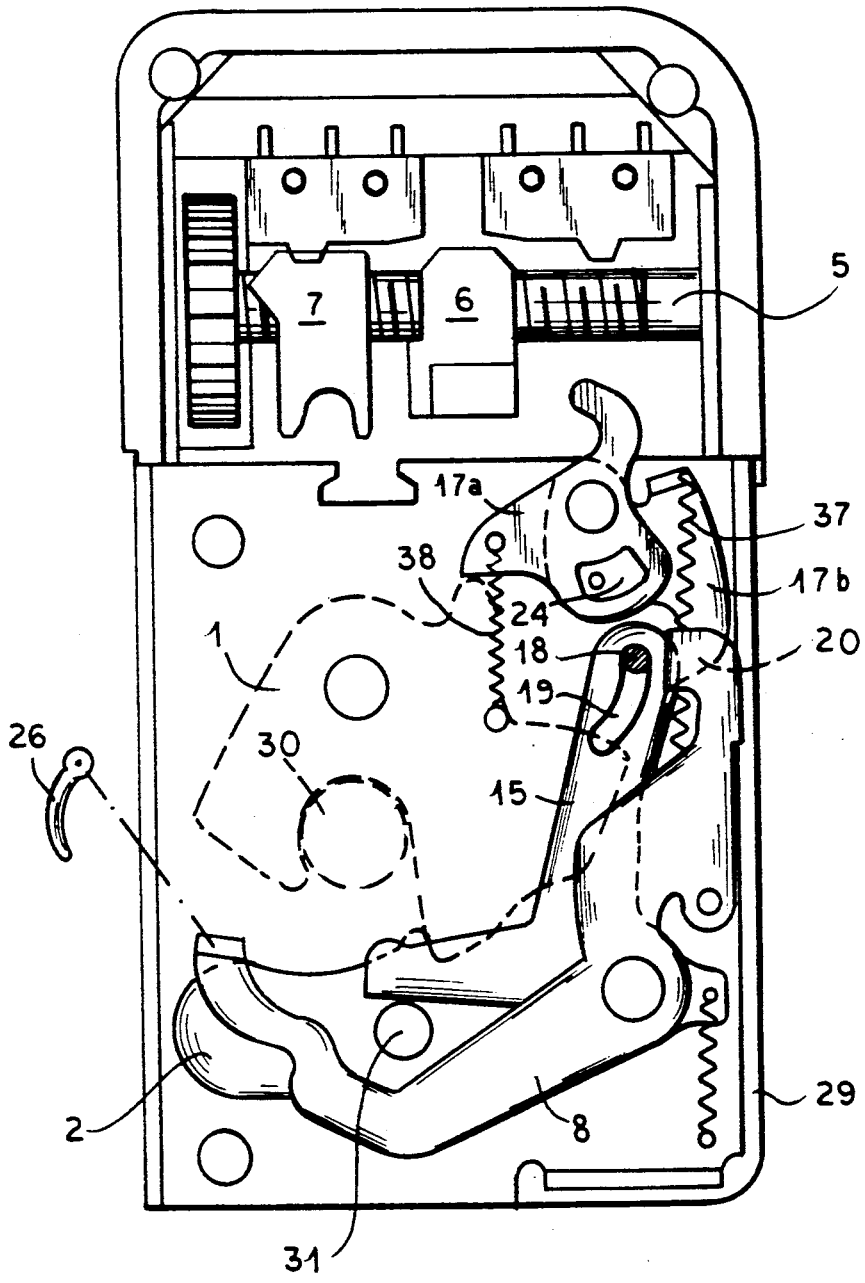
FIG. 2 is another section like FIG. 1, but with the section plane somewhat deeper in the latch but the latch still in the unlocked position.

Thus in the normal unlocked position of the door as shown in FIGS. 1 and 2 the pin 18 is at the top of the slot 19. A counterclockwise pivoting of the operating lever 8 will push the pin 18 to the left as seen in FIGS. 1 and 2 and the pawl 2 will be pushed down, releasing the fork 1. During such counterclockwise pivoting the entire link 16 will be shifted to the left by pivoting on the lever 13. A return spring 37 will return the link 16 to the FIG. 1 position when the handle 26 is not actuated, although of course it is standard to provide other return springs also.

Figure 3:
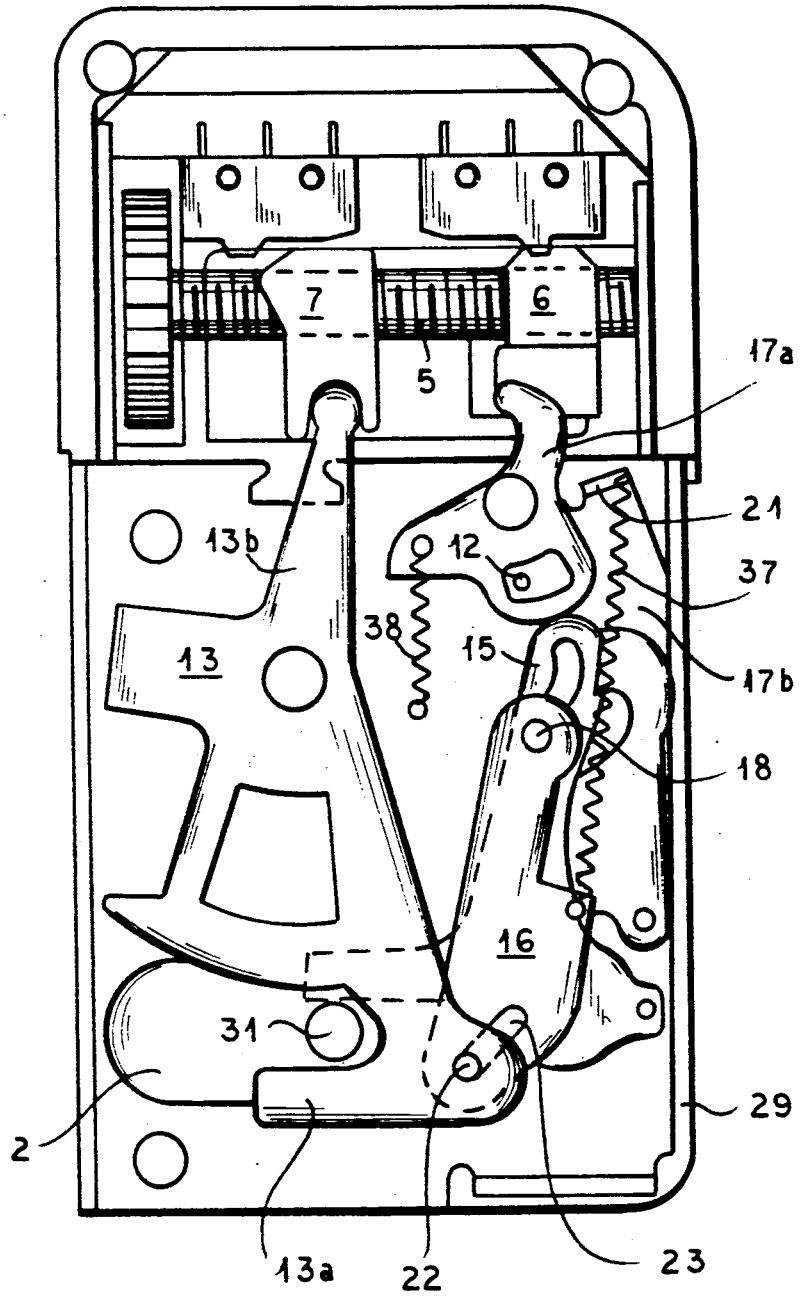
FIG. 3 is a vertical section like FIG. 1 through the latch in the locked position.

The latch is locked as shown in FIG. 3 by means of the lock cylinder 27 or the button 25. Both actuators pivot the lever 13 clockwise into the position L (FIG. 1) to engage an arm **13*a* of this lever 13 underneath the pin 31, thereby impeding its downward displacement and, with it, pivoting of the pawl 2 to free the fork 1. When initiated by the cylinder 27, this action also pulls down the button 25. In either case such pivoting of the lever 13 pulls the link 16 down to move the pin 18 down in the slot 19 so that this pin 18 is out of the path of the end of the operating lever 8. Thus when locked not only is pivoting of the pawl 2 impeded, but pivoting of the actuating lever 15 to pivot the pawl 2 is impossible because the actuating pin 18 cannot be acted upon by the lever 8. Thus if the door handle 26 or other mechanism that acts on the pin 18 in the position of FIGS. 1 and 2** is actuated to open the door, it cannot do so, so that in the unlocked position of the latch the door handles will operate but will not be connected to the latch mechanism.

In addition the lever 13 can be moved into the lock position of FIG. 3 by means of the motor 3 which rotates the spindle 5 to screw the nut 6 over against the slide 7 and push over an arm **13*b* of the lever 13 that is engaged in this slide 7. The slide 7 is not threaded on the spindle 5, however, so that so long as the nut 6 is to the right as seen in the drawing the lever 13*b* and slide 7** can freely move back and forth.

According to this invention a first antitheft lever **17*a* pivoted on the housing 29 has one end pressed by a biasing spring 38 toward engagement with the spindle nut 6 and is formed with a slot 24 in which is engaged a pin 12 of a second antitheft lever 17*b* having an end 20 that can engage over the pin 18 to impede its upward travel in the slot 19. The spring 37 which is hooked on the link 16 to pull it up is also hooked on the second anti-theft lever 17*b* to rotate it clockwise, but with a force smaller than that of the spring 38**.

Figure 4:
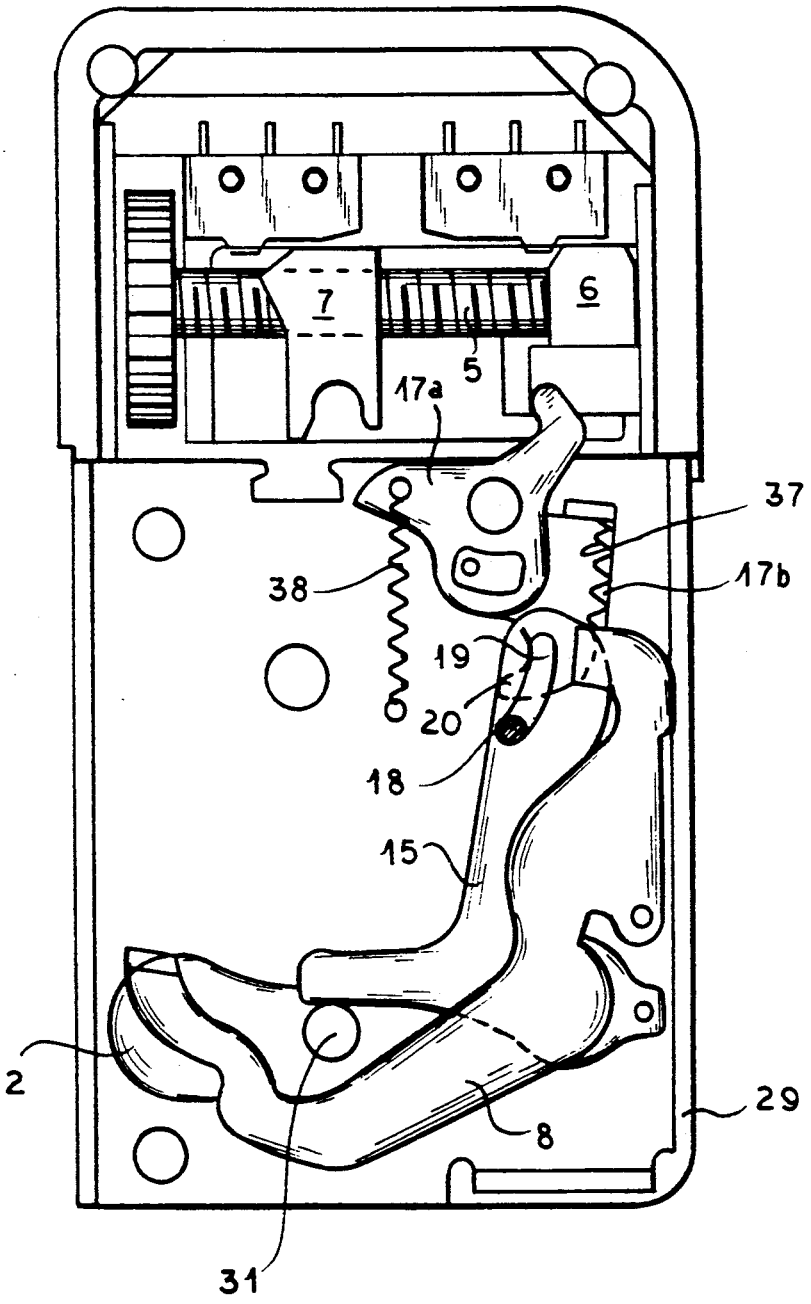
FIG. 4 is a vertical section like FIG. 1 through the latch but with the latch in the locked an antitheft position.

Thus when the motor 3 screws the nut 6 past the lock position into the antitheft position shown in FIG. 4 the lever **17*a* is pivoted clockwise and, once the lost-motion of the slot 24 is taken up, the lever 17*b* is also rotated clockwise until its end 20 engages over the pin 18. In this position an attempt to unlock the door resulting in counterclockwise pivoting of the lever 13 will be ineffective, since upward movement of the link 16 will be blocked by engagement of the pin 18 with the lever end 20. Thus in the antitheft position the pin 18 will, as in the lock position, be out of the path of the lever 8 and an attempt to unlock the door will merely result in sliding the pivot pin 22 in the slot 23. The spring 38 moves the levers 17*a* and 17*b* out of the antitheft position of FIG. 4 when the nut 6 is screwed to the left by the motor 3**.

The second antitheft lever **17*b* has a bent-over end 21 that can be engaged by the outer locking lever 11 in the override position O to pivot up this lever 17*b* and pull its end 20 out of the way of the pin 18, allowing it to return to the coupling position in which it permits the lever 8 to pivot the lever 15** and thereby open the door. Thus even in the event of an electrical failure with the latch in the antitheft position the door can be opened.

We claim:

1. A motor-vehicle door latch for use on a vehicle door having a handle and a locking element, the latch comprising:

a housing;

a latch fork pivotal on the housing and engageable in a locking position with a door bolt to retain same and lock the door;

an operating lever pivoted on the housing and connected to the handle;

a locking lever pivoted on the housing and connected to the respective locking element;

an actuating lever operatively engageable with the fork to release same from the locking position;

a link coupled to the locking lever and displaceable thereby between a position coupling the operating lever to the actuating lever for displacement of the fork out of the locking position by actuation of the operating lever and a position decoupling the operating lever from the actuating lever, whereby in the decoupling position actuation of the operating lever will not unlock the door;

central actuating means including an actuator in the latch displaceable into an antitheft position;

an antitheft lever displaceable by the actuator in the antitheft position thereof; and mechanism connected between the antitheft lever and the link for decoupling the locking lever from the actuating lever in the antitheft position of the antitheft lever, whereby in the antitheft position actuation of the inside lever will not be able to release the fork.

2. The motor-vehicle door latch defined in claim 1 wherein the antitheft lever is provided with a formation engageable with the link to retain same in the decoupling position in the antitheft position of the antitheft lever.

3. The motor-vehicle door latch defined in claim 2 wherein the link includes a pin, the actuating lever being formed with an elongated slot through which the pin projects, the formation of the antitheft lever being an abutment engageable with the pin.

4. The motor-vehicle door latch defined in claim 3 wherein the antitheft lever and locking lever are provided with interengageable override formations and the locking lever is displaceable into an override position engaging the override formations together and pulling the abutment of the antitheft lever out of engagement with the pin.

5. The motor-vehicle door latch defined in claim 1 wherein the actuator is a motor provided with a spindle in turn provided with a nut engaging the antitheft lever.

6. The motor-vehicle door latch defined in claim 1, further comprising a latch pawl connected between the actuating lever and the fork.

7. The motor-vehicle door latch defined in claim 1, wherein the mechanism includes a second antitheft lever pivotal independently of the first-mentioned antitheft lever and a lost-motion coupling interconnecting the two antitheft levers.

* * * * *